US005907940A

United States Patent [19]

Eddie

[11] Patent Number: 5,907,940

[45] Date of Patent: Jun. 1, 1999

[54] MULTI-PURPOSE HAND TOOL APPARATUS AND METHOD OF USING SAME

[76] Inventor: Rod Eddie, 14 Bridge St., Cornwall, N.Y. 12518

[21] Appl. No.: 08/885,402

[22] Filed: Jun. 30, 1997

Related U.S. Application Data

[62] Division of application No. 08/617,963, Mar. 18, 1996, Pat. No. 5,642,591.

[51] Int. Cl.[6] ..... E04G 21/26

[52] U.S. Cl. ..... 52/745.05; 52/127.2; 52/749.1; 52/DIG. 1; 254/113; 254/131

[58] Field of Search ..... 52/127.1, 127.2, 52/745.05, 745.09, 749.1, DIG. 1; 254/17, 113, 131

[56] References Cited

U.S. PATENT DOCUMENTS

| | | | |
|---|---|---|---|
| 1,848,426 | 3/1932 | Kvall . | |
| 3,574,981 | 4/1971 | Henschen | 52/127.2 |
| 3,883,117 | 5/1975 | Powell | 254/16 |
| 4,068,427 | 1/1978 | Camardo | 52/127.2 X |
| 4,079,556 | 3/1978 | Luck et al. | 52/127.2 |
| 4,826,137 | 5/1989 | Ahrgal | 254/132 |
| 5,462,385 | 10/1995 | Mohlengraft | 404/25 |
| 5,481,836 | 1/1996 | Miller et al. | 52/127.2 |
| 5,490,757 | 2/1996 | Stratman | 414/680 |
| 5,529,287 | 6/1996 | Pelosi, Jr. et al. | 254/129 |

*Primary Examiner*—Christopher Kent
*Assistant Examiner*—Timothy B. Kang

[57] ABSTRACT

Alternate methods of adjusting orientation of a wall are disclosed. The first such method includes the steps of establishing a fulcrum on a floor a predetermined distance from the wall, placing a lever in contact with the floor fulcrum, placing a push bar between the lever and the wall, and pushing against the lever towards the wall, whereby the push bar pushes the wall away from the lever. The second or alternate such method of adjusting orientation of a wall includes the steps of establishing a fulcrum on a floor a predetermined distance from the wall, placing a lever in contact with the floor fulcrum, connecting one end of a flexible line assembly to the lever and connecting the other end of the flexible line assembly to the wall, pulling the lever away from the wall, whereby the flexible line assembly pulls the wall towards the lever.

2 Claims, 5 Drawing Sheets

MULTI-PURPOSE HAND TOOL APPARATUS AND METHOD OF USING SAME

RELATED APPLICATIONS

This application is a divisional application of my prior application Ser. No. 08/617,963, filed Mar. 18, 1996 U.S. Pat. No. 5,642,591.

BACKGROUND OF THE INVENTION

1. Field of the Invention

The present invention relates generally to hand tools and, more particularly, to hand tools that have multiple features for performing multiple functions.

2. Description of the Prior Art

A number of multi-purpose hand tools are known that are used to perform a variety of functions. In the building trades, many multi-purpose hand tools share a common function, that of prying. The well know crow bar is typical example of a multi-purpose hand tool that can be used to carry out a prying function. Moreover, throughout the years, a number of innovations have been developed relating to multi-purpose hand tools that can be used for prying, and the following U.S. patents are representative of some of those innovations: 2,896,910, 2,937,004, and 4,762,303. More specifically, U.S. Pat. Nos. 2,896,910, 2,937,004, and 4,762,303 discloses a multi-purpose hand tool that can be used to carry out a prying function and joist-straightening function. In the building trades both the prying function and the joist-straightening function are important functions to perform with a hand tool. Therefore, for a multi-purpose hand tool that is used in the building trades, it would be desirable if the tool enables a person to carry out both a prying function and a joist-straightening function.

However, there are other important functions to be performed in the building trades that are not aided with the above-cited patents. For example, it is often necessary to straighten walls so that they can be braced in a straight orientation. In this respect, it would be desirable if a multi-purpose hand tool were provided that enables one to carry out a wall-straightening function. More specifically, sometimes a wall is leaning outward and must be pulled in to be straightened. In this respect, it would be desirable if a multi-purpose hand tool were provided that enables a person to pull in an outwardly leaning wall. At other times, a wall is leaning inward and must be pushed outward to be straightened. In this respect, it would be desirable if a multi-purpose hand tool were provided that enables a person to push out an inwardly leaning wall.

There are other instances at a work site where some object, such as a floor board or joist, must be jacked upward. In this respect, it would be desirable if a multi-purpose hand tool were provided that enables a person to jack a floor board or joist upward.

U.S. Pat. No. 4,512,554 may be of interest for its disclosure of a hand tool used for lifting and pulling a manhole cover. The tool employs a chain, a lever, and a fulcrum base. A hinge is employed for connecting the lever to the fulcrum base. It is well known that hinges undergo wear and tear during use. Moreover, hinges often develop annoying squeaking sounds when used. In this respect, it would be desirable if a multi-purpose hand tool were provided that does not employ a hinge connection between a lever and a fulcrum base.

U.S. Pat. No. 2,852,228 may be of interest for its disclosure of a hand tool used for prying and wrecking. There are two prying legs, one fulcrum member, and a clamping assembly for connecting the prying legs and the fulcrum member together. To avoid such complexities, it would be desirable if a multi-purpose hand tool included a one-piece structure that includes two prying legs and a fulcrum member.

Thus, while the foregoing body of prior art indicates it to be well known to use multi-purpose hand tools, the prior art described above does not teach or suggest a multi-purpose hand tool apparatus which has the following combination of desirable features: (1) enables a person to carry out both a prying function and a joist-straightening function; (2) enables a person to carry out a wall-straightening function; (3) enables a person to pull in an outwardly leaning wall; (4) enables a person to push out an inwardly leaning wall; (5) enables a person to jack a floor board or joist upward; (6) does not employ a hinge connection between a lever and a fulcrum base; and (7) includes a one-piece structure that includes two prying legs and a fulcrum member. The foregoing desired characteristics are provided by the unique multi-purpose hand tool apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a multi-purpose hand tool apparatus includes an elongated shank which includes a first shank end portion, a second shank end portion, and an intermediate shank portion. The elongated shank has a top side and a bottom side. A first U-shaped tool is attached to the first shank end portion. A second U-shaped tool is attached to the second shank end portion. A jack retainer attached to the elongated shank on the intermediate shank portion. The jack retainer is attached to the top side of the elongated shank and may be in the form of a bucket. One side of the first U-shaped tool is formed from a portion of the first shank end portion of the elongated shank.

The second U-shaped tool is comprised of a single, unified U-shaped tool member. The single, unified U-shaped tool member is oriented at an oblique orientation angle with respect to the elongated shank. More specifically, the single, unified U-shaped tool member extends at the oblique orientation angle toward the bottom side of the elongated shank. The single, unified U-shaped tool member includes a central portion which is connected to the top side of the elongated shank and includes fork portions which extend past the bottom side of the elongated shank, making the oblique orientation angle with respect to the elongated shank.

A line connection assembly is attached to the intermediate shank portion of the elongated shank. The line connection assembly includes a base member connected to the intermediate shank portion, a line hook, and a pivot pin connected between the base member and the line hook. The line connection assembly is attached to the bottom side of the elongated shank.

A flexible line assembly is connected to the line connection assembly, and a wall hook is connected to the flexible line assembly. The flexible line assembly includes a chain assembly connected to the line connection assembly. The wall hook is a single, unified U-shaped wall-hook member which has a free end and a connected end which is connected to the flexible line assembly.

In accordance with another aspect of the invention, a method of adjusting orientation of a wall includes the steps of establishing a fulcrum on a floor a predetermined distance from the wall, placing a lever in contact with the floor fulcrum, placing a push bar between the lever and the wall, and pushing against the lever towards the wall, whereby the push bar pushes the wall away from the lever.

In accordance with another aspect of the invention, a method of adjusting orientation of a wall includes the steps of establishing a fulcrum on a floor a predetermined distance from the wall, placing a lever in contact with the floor fulcrum, connecting one end of a flexible line assembly to the lever and connecting the another end of the flexible line assembly to the wall, pulling the lever away from the wall, whereby the flexible line assembly pulls the wall towards the lever.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-purpose hand tool apparatus which has all of the advantages of the prior art and none of the disadvantages.

It is another object of the present invention to provide a new and improved multi-purpose hand tool apparatus which may be easily and efficiently manufactured and marketed.

It is a further object of the present invention to provide a new and improved multi-purpose hand tool apparatus which is of durable and reliable construction.

An even further object of the present invention is to provide a new and improved multi-purpose hand tool apparatus which is susceptible of a low cost of manufacture with regard to both materials and labor, and which accordingly is then susceptible of low prices of sale to the consuming public, thereby making such multi-purpose hand tool apparatus available to the buying public.

Still yet a further object of the present invention is to provide a new and improved multi-purpose hand tool apparatus which enables a person to carry out both a prying function and a joist-straightening function.

Still another object of the present invention is to provide a new and improved multi-purpose hand tool apparatus that enables a person to carry out a wall-straightening function.

Yet another object of the present invention is to provide a new and improved multi-purpose hand tool apparatus which enables a person to pull in an outwardly leaning wall.

Even another object of the present invention is to provide a new and improved multi-purpose hand tool apparatus that enables a person to push out an inwardly leaning wall.

Still a further object of the present invention is to provide a new and improved multi-purpose hand tool apparatus which enables a person to jack a floor board or joist upward.

Yet another object of the present invention is to provide a new and improved multi-purpose hand tool apparatus that does not employ a hinge connection between a lever and a fulcrum base.

Still another object of the present invention is to provide a new and improved multi-purpose hand tool apparatus which includes a one-piece structure that includes two prying legs and a fulcrum member.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
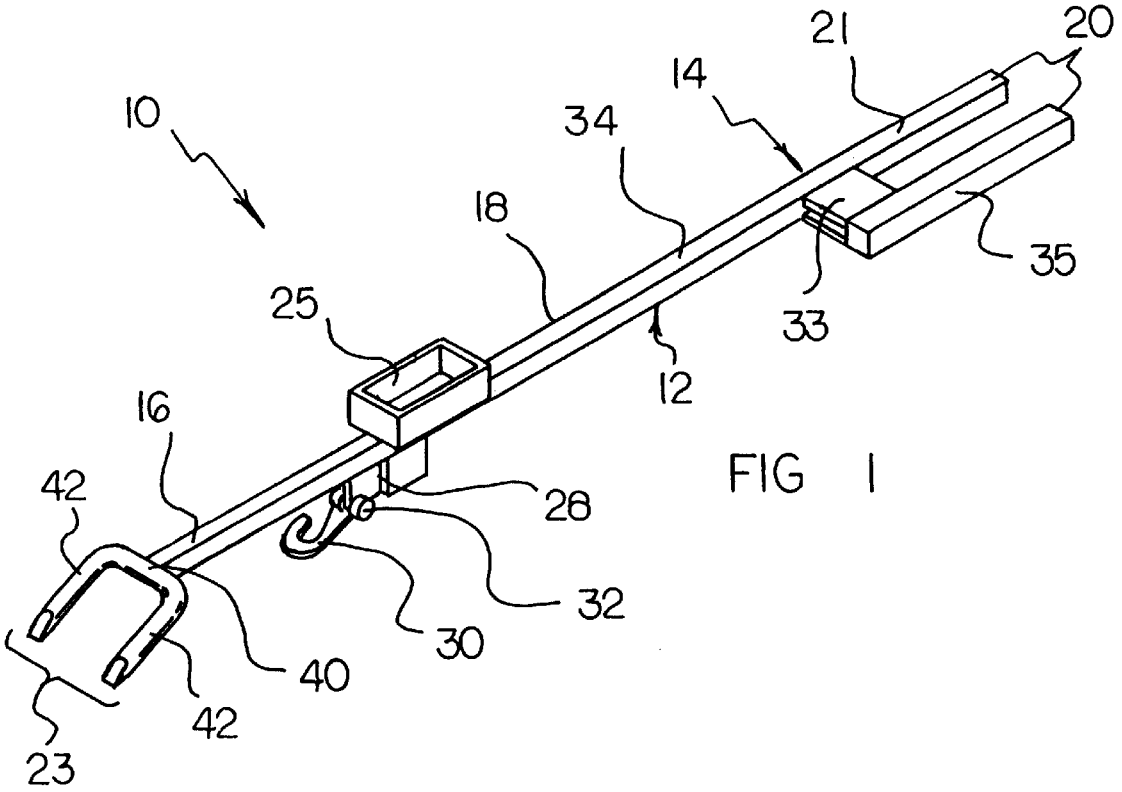
FIG. 1 is a perspective view showing a first embodiment of the multi-purpose hand tool apparatus of the invention.
Figure 2:
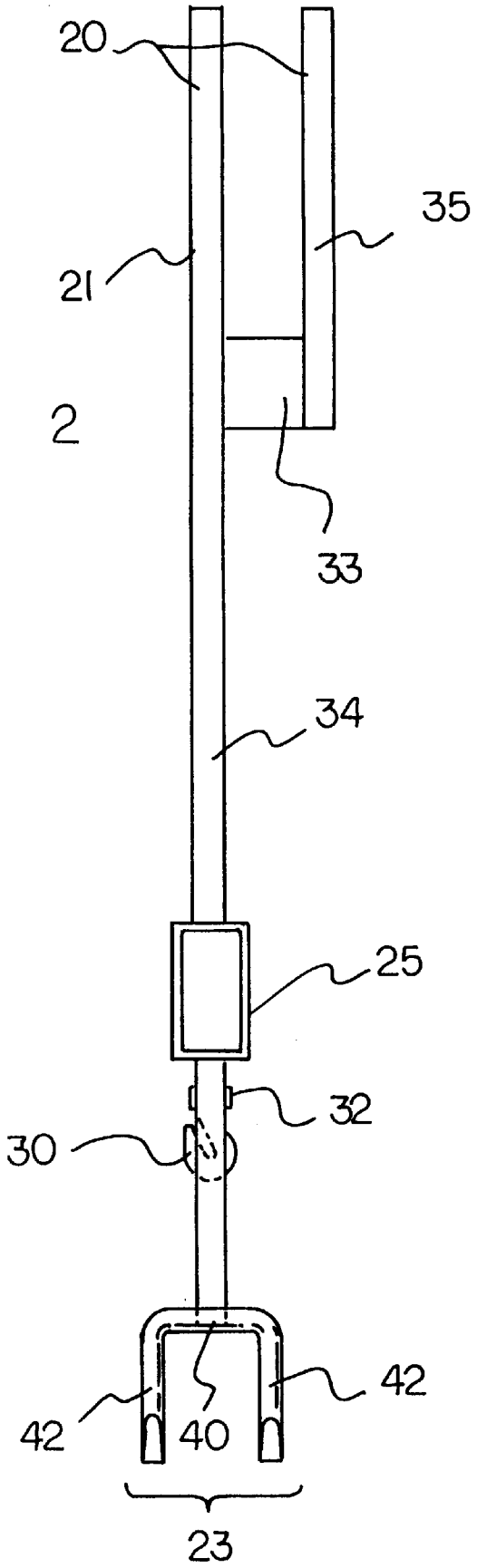
FIG. 2 is a top view of the embodiment of the multi-purpose hand tool apparatus shown in FIG. 1.
Figure 3:
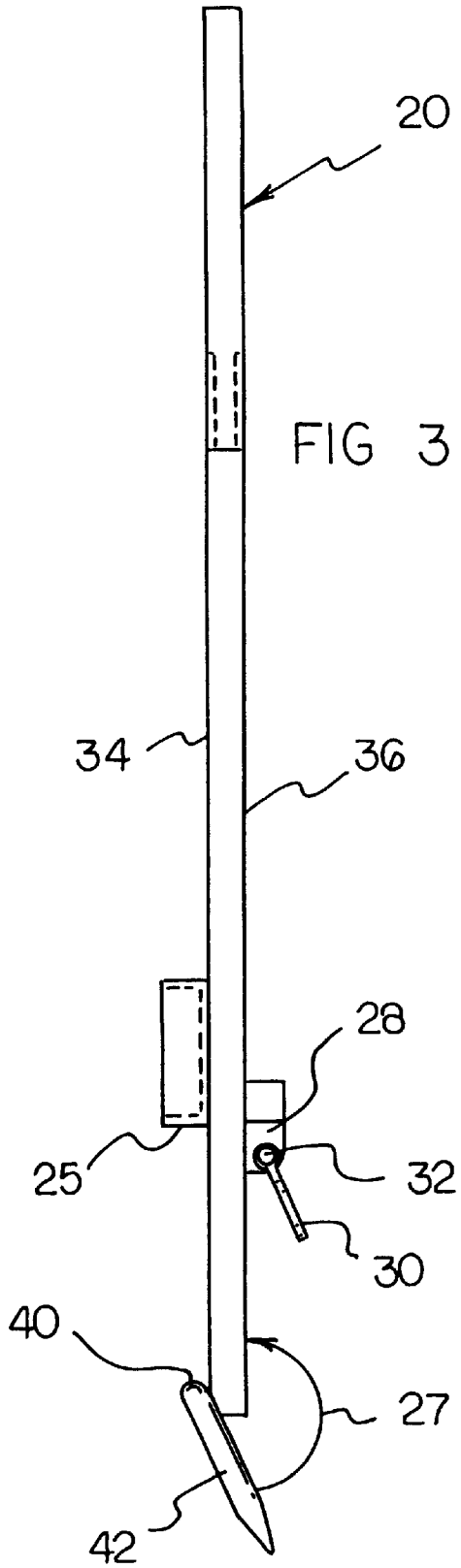
FIG. 3 is a side view of the embodiment of the multi-purpose hand tool apparatus shown in FIG. 1.

With reference to the drawings, a new and improved multi-purpose hand tool apparatus embodying the principles and concepts of the present invention will be described.

Turning to FIGS. 1–6, there is shown a first embodiment of the multi-purpose hand tool apparatus of the invention generally designated by reference numeral 10. In the first embodiment, multi-purpose hand tool apparatus 10 includes an elongated shank 12 which includes a first shank end portion 14, a second shank end portion 16, and an intermediate shank portion 18. The elongated shank 12 has a top side 34 and a bottom side 36. A first U-shaped tool 20 is attached to the first shank end portion 14. A second U-shaped tool is attached to the second shank end portion 16. A jack retainer attached to the elongated shank 12 on the intermediate shank portion 18. The jack retainer is attached to the top side 34 of the elongated shank 12 and may be in the form of a bucket 25. One side 21 of the first U-shaped tool 20 is formed from a portion of the first shank end portion 14 of the elongated shank 12. With this embodiment of the first U-shaped tool 20, a bridge element 33 is connected to the one side 21 of the elongated shank 12, and a strut 35 is connected to the bridge element 33. The strut 35 is parallel to the one side 21 of the elongated shank 12.

The second U-shaped tool is comprised of a single, unified U-shaped tool member 23. The single, unified U-shaped tool member 23 is oriented at an oblique orientation angle 27 with respect to the elongated shank 12. More specifically, the single, unified U-shaped tool member 23 extends at the oblique orientation angle 27 toward the bottom side 36 of the elongated shank 12. Even more specifically, The single, unified U-shaped tool member 23 includes a central portion 40 which is connected to the top side 34 of the elongated shank 12 and includes fork portions 42 which extend past the bottom side 36 of the elongated shank 12, making the oblique orientation angle 27 with respect to the elongated shank 12.

A line connection assembly is attached to the intermediate shank portion 18 of the elongated shank 12. The line connection assembly includes a base member 28 connected to the intermediate shank portion 18, a line hook 30, and a pivot pin 32 connected between the base member 28 and the line hook 30. The line connection assembly is attached to the bottom side 36 of the elongated shank 12. All of the elements that are attached to the elongated shank 12 can be attached by being welded to the elongated shank 12.

Figure 4:
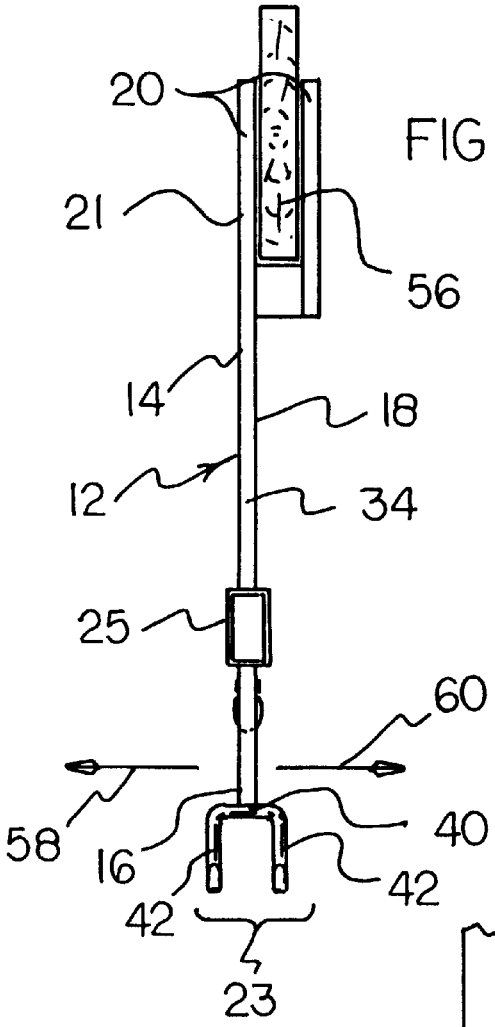
FIG. 4 is a top view of the first embodiment of the invention used for aligning a joist.

The first embodiment of the invention can be used in a number of ways. For example, as shown in FIG. 4, the first U-shaped tool 20 can straddle a joist 56. Then, a torque is applied at the second shank end portion 16 of the elongated shank 12. That is, a person grasps the second shank end portion 16 of the elongated shank 12 and moves the elongated shank 12 towards the left or the right as shown by left arrow 58 and right arrow 60, respectively. By applying torque as described, the orientation of the joist 56 can be changed or tweaked. More specifically, when the second shank end portion 16 is moved to the left, the joist 56 is rotated to the left. Conversely, when the second shank end portion 16 is moved to the right, the joist 56 is rotated to the right.

Figure 5:
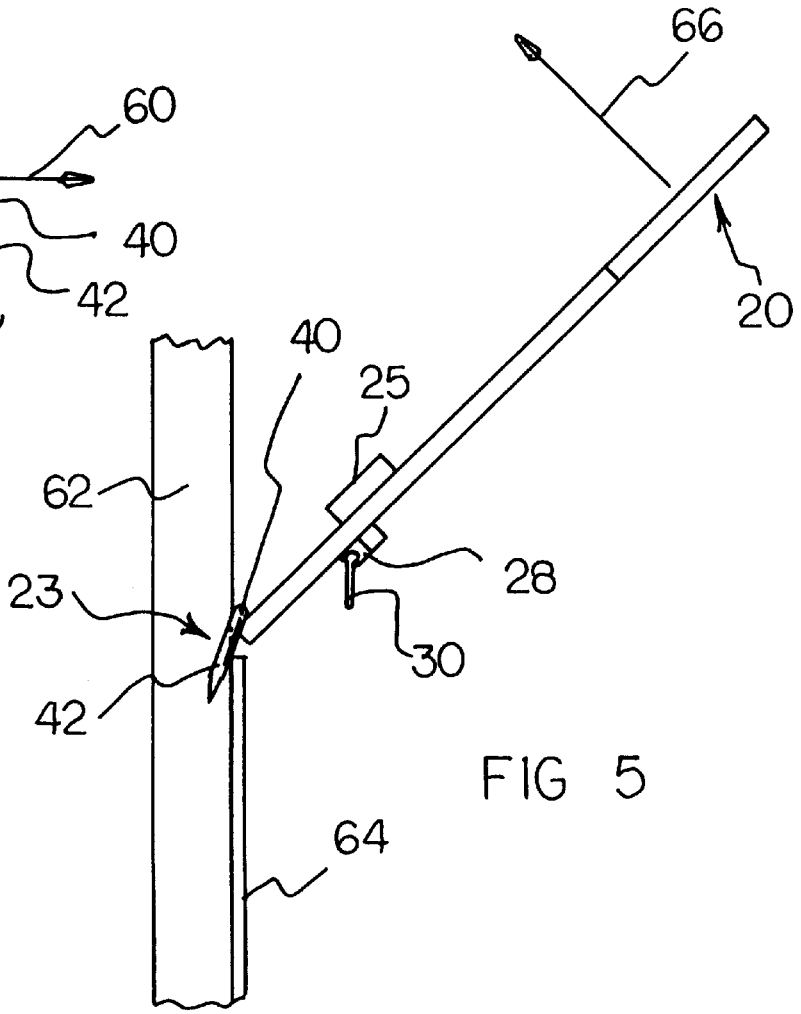
FIG. 5 is side view of the first embodiment of the invention used for prying one board off of another board.

The first embodiment of the invention can be used in a second way, that of a prying tool, as shown in FIG. 5. More specifically, the central portion 40 of the single, unified U-shaped tool member 23 is placed on a first board 62. A second board 64 has been nailed to the first board 62. The fork portions 42 of the single, unified U-shaped tool member 23 are placed under an edge of the second board 64. Then, a torque is applied on the first U-shaped tool 20 in the direction of the arrow 66 shown in FIG. 5. When this is done, the first U-shaped tool 20 serves as a handle, and the fork portions 42 of the single, unified U-shaped tool member 23 pry or lift the edge of the second board 64 off of the first board 62, also pulling any nails, if used, out of the first board 62. The prying action can be used at different locations around the second board 64 to help completely pry the second board 64 loose from the first board 62. The first board 62 and the second board 64 can be comprised of a variety of boards, including, but not limited to joists, studs, braces, and laths.

Figure 6:
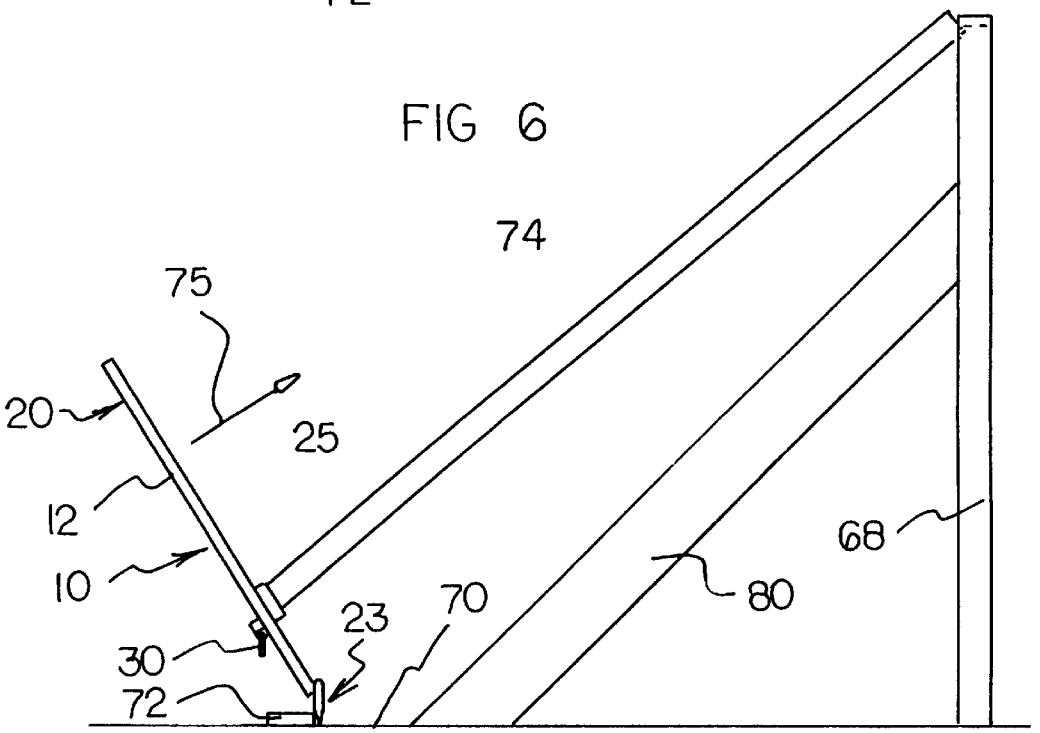
FIG. 6 is a side view of the first embodiment of the invention being used to push on a wall.

A third use of the first embodiment of the invention is shown in FIG. 6. As shown in FIG. 6, the first embodiment of the invention can be used to push a wall 68. More specifically, a fulcrum is established on the floor 70. To do so, a fulcrum board 72 may be nailed onto the floor 70. Either the first U-shaped tool 20 or the second U-shaped tool is placed in contact with the fulcrum board 72. Preferably, the second U-shaped tool, that is the single, unified U-shaped tool member 23, is placed in contact with the fulcrum board 72. One end of the stud 74 is placed in the bucket 25 which is a jack retainer. The other end of the stud 74 is placed against a side portion of the wall 68 near the top thereof. The stud 74 may be notched to grip the wall 68. Then, as shown in FIG. 6, the first U-shaped tool 20 is pushed in the direction of arrow 75, which is towards the wall 68. When this is done, a force is transmitted from the bucket 25, through the stud 74, and to the wall 68 to push the wall 68 in the direction of the arrow 77. Once the wall 68 is oriented at the desired orientation, such as perpendicular to the floor 70, a brace 80 can be nailed between the floor 70 and the wall 68 to secure the wall 68 at the desired orientation.

The length of the stud 74 can be selected, taking into consideration the height of the wall 68. For example, a nine feet stud can be used for a nine feet wall. An eight feet stud can be used for an eight feet wall, and so on.

Figure 8:
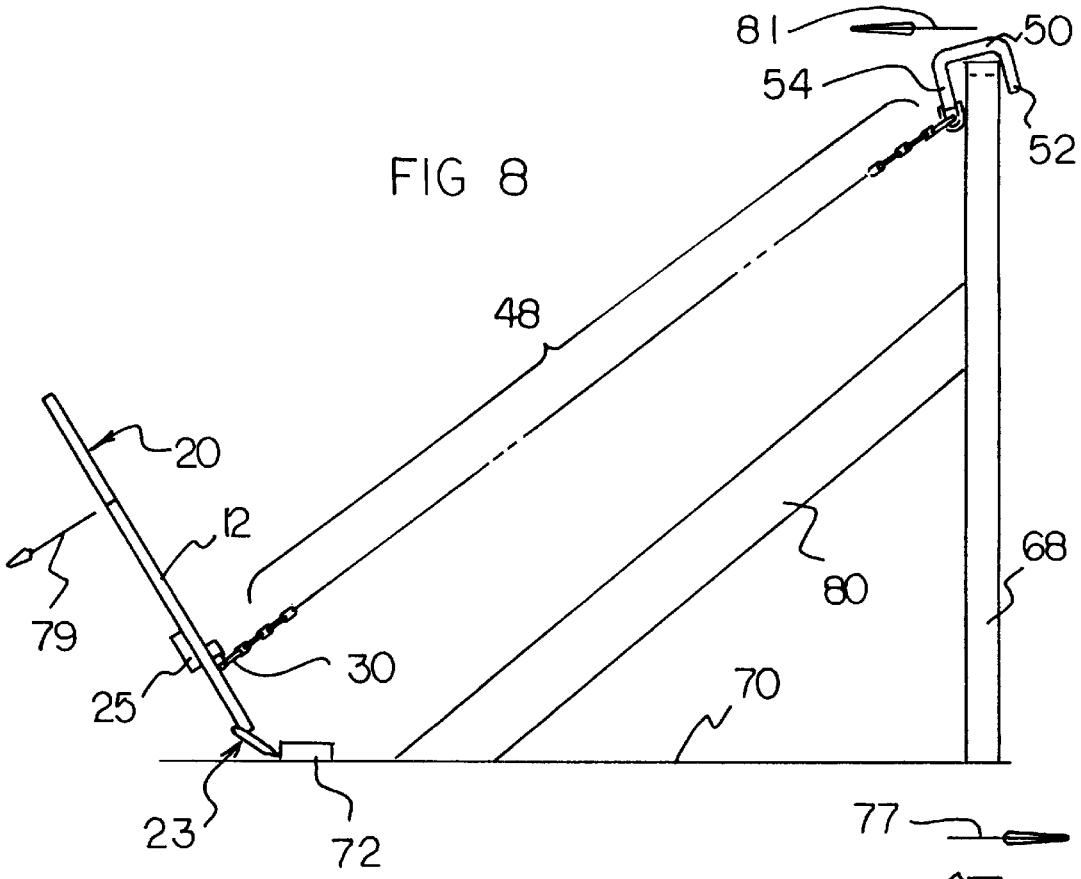
FIG. 8 is a side view of the second embodiment of the invention being used to pull on a wall that is hooked by the wall-hook portion.
Figure 7:
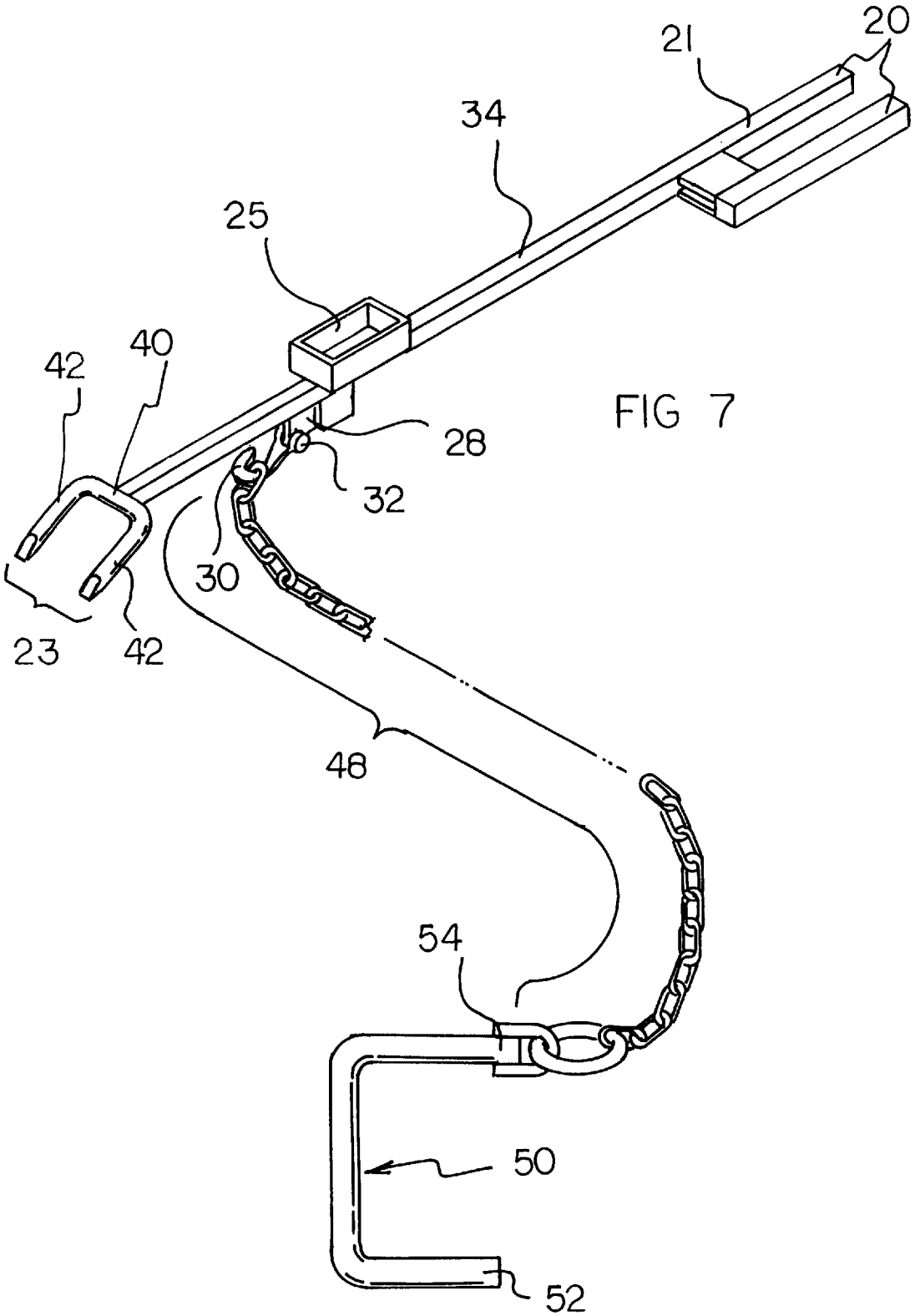
FIG. 7 is a perspective view of a second embodiment of the invention which includes an attached chain portion and a wall-hook portion.

Turning to FIGS. 7 and 8, a second embodiment of the invention is shown. Reference numerals are shown that correspond to like reference numerals that designate like elements shown in the other figures. In addition, a flexible line assembly is connected to the line connection assembly, and a wall hook is connected to the flexible line assembly. The flexible line assembly includes a chain assembly 48 connected to the line connection assembly. The wall hook is a single, unified U-shaped wall-hook member 50 which has a free end 52 and a connected end 54 which is connected to the flexible line assembly.

The second embodiment of the invention of the invention can be used to pull on a wall 68, as shown in FIG. 8. More specifically, a fulcrum is established in the floor 70 such as by using fulcrum board 72. The fulcrum board 72 can be placed any suitable distance from the wall 68. It has been determined that placing the fulcrum board 72 at a distance from the wall 68 which is approximately two-thirds the height of the wall 68 is suitable. The single, unified U-shaped wall-hook member 50 is placed over the top of the wall 68. The chain assembly 48 is stretched so that the chain assembly 48 is connected to the line hook 30 of the line connection assembly on the elongated shank 12. Either the first U-shaped tool 20 or the second U-shaped tool is placed in contact with the fulcrum board 72. Preferably, the second U-shaped tool, that is the single, unified U-shaped tool member 23, is placed in contact with the fulcrum board 72. Then, a person applies a force against the first U-shaped tool 20 in the direction of arrow 79 which is away from the wall 68. In this way, a pulling force is transmitted from the line hook 30, through the chain assembly 48, to the connected end 54 of the single, unified U-shaped wall-hook member 50, and to the free end 52 of the wall 68 to pull the wall 68 in the direction of arrow 81 which is towards the elongated shank 12 of the invention. Once the wall 68 is oriented at the desired orientation, such as perpendicular to the floor 70, a brace 80 can be nailed between the floor 70 and the wall 68 to secure the wall 68 at the desired orientation. Then, either the first U-shaped tool 20 or the second U-shaped tool can be used to lift the single, unified U-shaped wall-hook member 50 off of the wall 68, without the need of a ladder.

In yet another use of either the first or the second embodiments of the invention, the multi-purpose hand tool apparatus 10 of the invention can be laid relatively flat on a floor with the bucket 25 oriented upward. Then, a stud 74 can be placed in the bucket 25 where the stud 74 is in a substantially vertical orientation. Then one end of the multi-purpose hand tool apparatus 10 can be lifted upward, using the other end of the multi-purpose hand tool apparatus 10 as a fulcrum. As this is done, the vertically oriented stud 74 can be used as a vertically orienting jack for an overhead floor board or joist. Once the overhead floor board or joist has been jacked up or lowered to a desired vertical distance from the floor, a brace can be inserted between the floor and the floor board or joist to maintain the desired distance.

The uses of the first and second embodiments of the invention described above do not exclude other uses which are many. Some of the uses of the embodiments of the invention are in framing jobs as described above. In addition, the embodiments of the invention can be used by other workers in other environments. For example, the embodiments of the invention can be used by fire fighters, by police, by steel workers, and by fence workers, to name a few.

In accordance with another aspect of the invention, a method is provided for orienting a wall by pushing on the wall. More specifically, method of adjusting orientation of a wall includes the steps of establishing a fulcrum on a floor a predetermined distance from the wall, placing a lever in contact with the floor fulcrum, placing a push bar between the lever and the wall, and pushing against the lever towards the wall, whereby the push bar pushes the wall away from the lever. This method is especially useful for pushing outward a wall that is leaning inward. This method has been described above in detail in relation to using the first embodiment of the invention and in reference to FIG. 6.

In accordance with yet another aspect of the invention, a method is provided for orienting a wall by pulling on the wall. More specifically, method of adjusting orientation of a wall includes the steps of establishing a fulcrum on a floor a predetermined distance from the wall, placing a lever in contact with the floor fulcrum, connecting one end of a flexible line assembly to the lever and connecting the another end of the flexible line assembly to the wall, pulling the lever away from the wall, whereby the flexible line assembly pulls the wall towards the lever. This method is especially useful for pulling inward a wall that is leaning outward. This method has been described above in detail in relation to using the second embodiment of the invention and in reference to FIG. 8.

The components of the multi-purpose hand tool apparatus of the invention can be made from inexpensive and durable metal materials, e.g. steel.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved multi-purpose hand tool apparatus that is low in cost, relatively simple in design and operation, and which may advantageously be used enable a person to carry out both a prying function and a joist-straightening function. With the invention, a multi-purpose hand tool apparatus is provided which enables a person to carry out a wall-straightening function. With the invention, a multi-purpose hand tool apparatus is provided which enables a person to pull in an outwardly leaning wall and to push out an inwardly leaning wall. With the invention, a multi-purpose hand tool apparatus is provided which enables a person to jack a floor board or joist upward. With the invention, a multi-purpose hand tool apparatus is provided which does not employ a hinge connection between a lever and a fulcrum base. With the invention, a multi-purpose hand tool apparatus is provided which includes a second U-shaped tool which has a one-piece structure that includes two prying legs and a fulcrum member.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A method of adjusting orientation of a wall, comprising the steps of:

establishing a fulcrum on a floor a predetermined distance from the wall, placing a lever in contact with the floor fulcrum, placing a push bar between the lever and the wall, and pushing against the lever towards the wall, whereby the push bar pushes the wall away from the levers including the further step of providing said lever before the step of placing the lever in contact with the floor fulcrum, and wherein said lever comprises:

an elongated shank which includes a first shank end portion, a second shank end portion, and an intermediate shank portion, wherein said elongated shank has a top side and a bottom side, a first U-shaped tool attached to said first shank end portion, a second U-shaped tool attached to said second shank end portion, and a lack retainer attached to said elongated shank on said intermediate shank portion.

2. A method of adjusting orientation of a wall, comprising the steps of:

establishing a fulcrum on a floor a predetermined distance from the wall, placing a lever in contact with the floor fulcrum, connecting one end of a flexible line assembly to the lever and connecting the other end of the flexible line assembly to the wall, and pulling the lever away from the wall, whereby the flexible line assembly pulls the wall towards the lever, including the further step of providing said lever before the step of placing the lever in contact with the floor fulcrum, and wherein said lever comprises:

an elongated shank which includes a first shank end portion, a second shank end portion, and an intermediate shank portion, wherein said elongated shank has a top side and a bottom side, a first U-shaped tool attached to said first shank end portion, a second U-shaped tool attached to said second shank end portion, and a jack retainer attached to said elongated shank on said intermediate shank portion.

* * * * *